US009952555B2

(12) United States Patent
Kusano et al.

(10) Patent No.: US 9,952,555 B2
(45) Date of Patent: Apr. 24, 2018

(54) CARTRIDGE CONFIGURED TO BE REMOVABLY ATTACHABLE TO AN IMAGE FORMING APPARATUS

(71) Applicant: CANON KABUSHIKI KAISHA, Tokyo (JP)

(72) Inventors: Yohei Kusano, Numazu (JP); Takayuki Yada, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/291,420

(22) Filed: Oct. 12, 2016

(65) Prior Publication Data

US 2017/0108827 A1 Apr. 20, 2017

(30) Foreign Application Priority Data

Oct. 14, 2015 (JP) ..... 2015-203210
Aug. 24, 2016 (JP) ..... 2016-163642

(51) Int. Cl.
*G03G 15/00* (2006.01)
*G03G 21/18* (2006.01)

(52) U.S. Cl.
CPC ..... *G03G 21/1842* (2013.01)

(58) Field of Classification Search
CPC ..... G03G 21/1842
USPC ..... 399/111
See application file for complete search history.

(56) References Cited

U.S. PATENT DOCUMENTS 5,745,823 A 4/1998 Goto et al.
8,630,564 B2 * 1/2014 Ueno ..... G03G 15/757 399/111
8,676,090 B1 3/2014 Ueno et al.
2014/0270845 A1 * 9/2014 Kawakami ..... G03G 21/186 399/110

FOREIGN PATENT DOCUMENTS

EP 0520802 A 12/1992
JP 2012155166 A 8/2012
WO 2008081966 A1 7/2008

OTHER PUBLICATIONS

Extended European Search Report issued in European Patent Application No. 16193720.6 dated Feb. 8, 2017.

* cited by examiner

*Primary Examiner* — Quana M Grainger
(74) *Attorney, Agent, or Firm* — Rossi, Kimms & McDowell LLP

(57) ABSTRACT

Disclosed is a cartridge attachable/detachable to/from an apparatus body of an image forming apparatus. A bearing member for pivotally supports a rotation member has an engaged portion that is arranged at a part on one end side of the cartridge in a direction of a rotational axis of the rotation member and engaged with an engaging portion provided in the apparatus body. An engagement state between the engaged portion and the engaging portion is maintained until at least a coupling of the rotation member is coupled to a driving shaft provided in the apparatus body in a process of attaching the cartridge to the apparatus body. A movement of the bearing member to at least the other end side in the direction of the rotational axis with respect to the apparatus body is restricted when the engaged portion and the engaging portion are put into the engagement state.

14 Claims, 17 Drawing Sheets

CARTRIDGE CONFIGURED TO BE REMOVABLY ATTACHABLE TO AN IMAGE FORMING APPARATUS

BACKGROUND OF THE INVENTION

Field of the Invention

The present invention relates to an image forming apparatus in which a cartridge is configured to be attachable/detachable.

Description of the Related Art

A known image forming apparatus that forms an image on a recording material using an electrophotographic system employs a process cartridge system in which an electrophotographic photosensitive body (photosensitive drum) and a process unit acting on the electrophotographic photosensitive body are integrated into a process cartridge and the integrated process cartridge is configured to be attachable/detachable to/from an apparatus body. Since the process cartridge system allows a user to perform apparatus maintenance by himself/herself, it displays excellent usability and has been widely used in recent image forming apparatuses. Image forming apparatuses employing the process cartridge system may require a configuration in which a process cartridge attached to an apparatus body is positioned with respect to an apparatus body. For example, Japanese Patent Application Laid-open No. 2012-155166 discloses a configuration in which the position of an entire process cartridge in a drum axis direction is determined in the process of attaching the process cartridge to an apparatus body to determine the position of a photosensitive drum in the axis direction.

In the configuration of Japanese Patent Application Laid-open No. 2012-155166, however, a plurality of other components is interposed between a part positioned with respect to the apparatus body and the photosensitive drum in the process cartridge. Therefore, the dimensional accuracy, the assembling accuracy, or the like of the plurality of other components greatly influences the positioning accuracy of the photosensitive drum in a longitudinal direction.

SUMMARY OF THE INVENTION

It is an object of the present invention to provide a technology by which it is possible to more accurately perform the positioning of a rotation member such as a photosensitive drum in an axis direction.

In addition, it is another object of the present invention to provide a cartridge configured to be removably attachable to an apparatus body of an image forming apparatus, the cartridge comprising:

a rotation member comprising a coupling configured to be coupleable to a driving shaft provided in the apparatus body and to rotate by receiving a driving force from the driving shaft; and a bearing member configured to pivotally support the rotation member, wherein the bearing member has an engaged portion that is positioned on one end side of the cartridge in a direction of a rotational axis of the rotation member and configured to engage with an engaging portion provided in the apparatus body, such that an engagement state between the engaged portion and the engaging portion is maintained until at least the coupling is coupled to the driving shaft in a process of attaching the cartridge to the apparatus body, and such that a movement of the bearing member towards, at least, the other end side of the cartridge in the direction of the rotational axis is restricted when the engaged portion and the engaging portion are put into the engagement state.

In addition, it is another object of the present invention to provide an image forming apparatus in which a cartridge provided with a rotation member is configured to be removably attachable to an apparatus body having a driving shaft that configured to transmit a driving force to the rotation member, wherein the apparatus body comprises a support member configured to rotatably, pivotally support the driving shaft and having an engaging portion configured to restrict movement of the rotation member in the direction of a rotational axis of the rotation member, the cartridge comprises a bearing member configured to pivotally supports the rotation member and an engaged portion, the engaged portion being positioned at one end side of the cartridge in the direction of the rotational axis of the rotation member and being engagable with the engaging portion, such that an engagement state between the engaging portion and the engaged portion is maintained until the rotation member is coupled to the driving shaft in a process of attaching the cartridge to the apparatus body, and such that a movement of the bearing member towards, at least, the other end side of the cartridge in the direction of the rotational axis of the rotation member is restricted when the engaged portion and the engaging portion are put into the engagement state.

Further features of the present invention will become apparent from the following description of exemplary embodiments (with reference to the attached drawings).

DESCRIPTION OF THE EMBODIMENTS

The following provides a detailed exemplary explanation of embodiments of this invention based on examples with reference to the drawings. However, the dimensions, materials, shapes and relative arrangement of constituent components described in the embodiments may be suitably modified according the configuration and various conditions of the apparatus to which the invention is applied. Namely, the scope of this invention is not intended to be limited to the following embodiments. Each of the embodiments of the present invention described below can be implemented solely or as a combination of a plurality of the embodiments or features thereof where necessary or where the combination of elements or features from individual embodiments in a single embodiment is beneficial.

First Embodiment

An electrophotographic image forming apparatus according to an embodiment of the present invention is one in which a process cartridge is configured to be freely attachable/detachable to/from an apparatus body. The electrophotographic image forming apparatus (hereinafter called the image forming apparatus) forms an image on a recording medium (recording material) using an electrophotographic image forming system. Examples of the image forming apparatus include an electrophotographic copier, an electrophotographic printer (such as an LED printer and a laser beam printer), a facsimile machine, and a word processor.

Here, the process cartridge is one in which an electrophotographic photosensitive drum (hereinafter called a photosensitive drum) and a process unit acting on the photosensitive drum are integrated into a cartridge, and which is attachable/detachable to/from the image forming apparatus body. Examples of the configuration of the process cartridge include one in which the photosensitive drum and at least one of a development unit, a charging unit, and a cleaning unit serving as the process unit are integrated into a cartridge.

In the following description, the direction of the rotational axis of the photosensitive drum will be defined as a longitudinal direction. In addition, in the longitudinal direction, a side on which the photosensitive drum receives a driving force from the image forming apparatus body will be defined as a driving side (one end side), and its opposite side will be defined as a non-driving side (the other end side).

Figure 2:
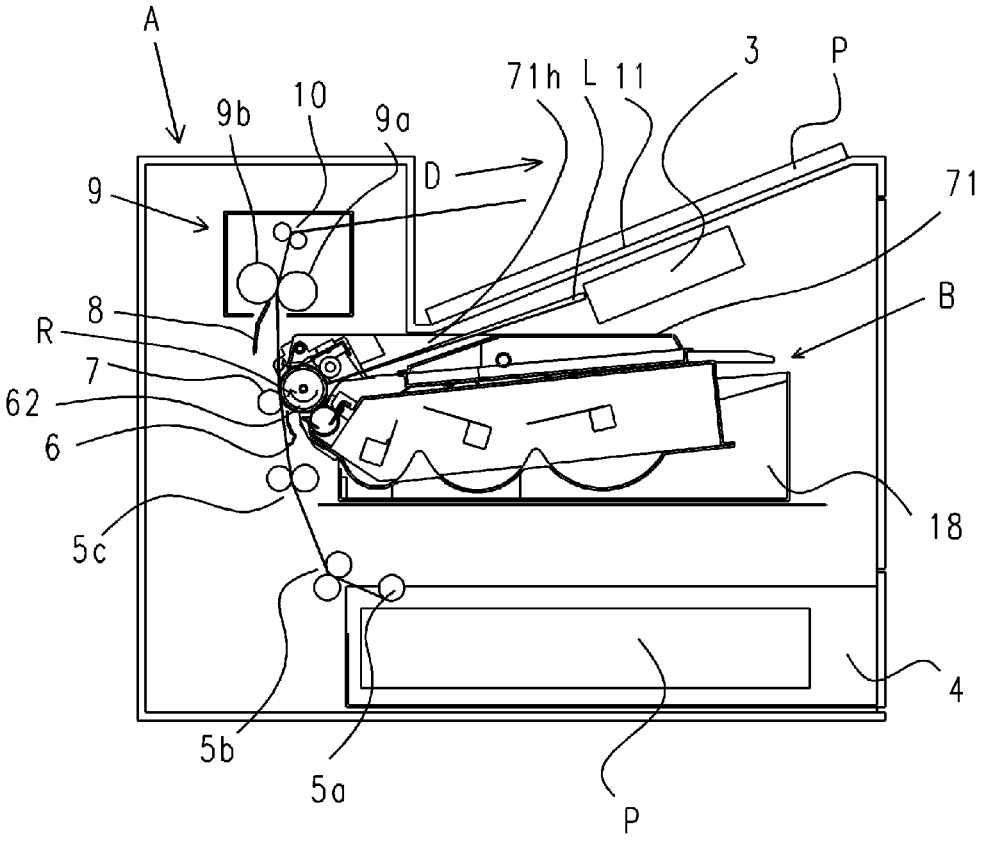
FIG. 2 is a cross-sectional view of an image forming apparatus body and the process cartridge according to the first embodiment.
Figure 3:
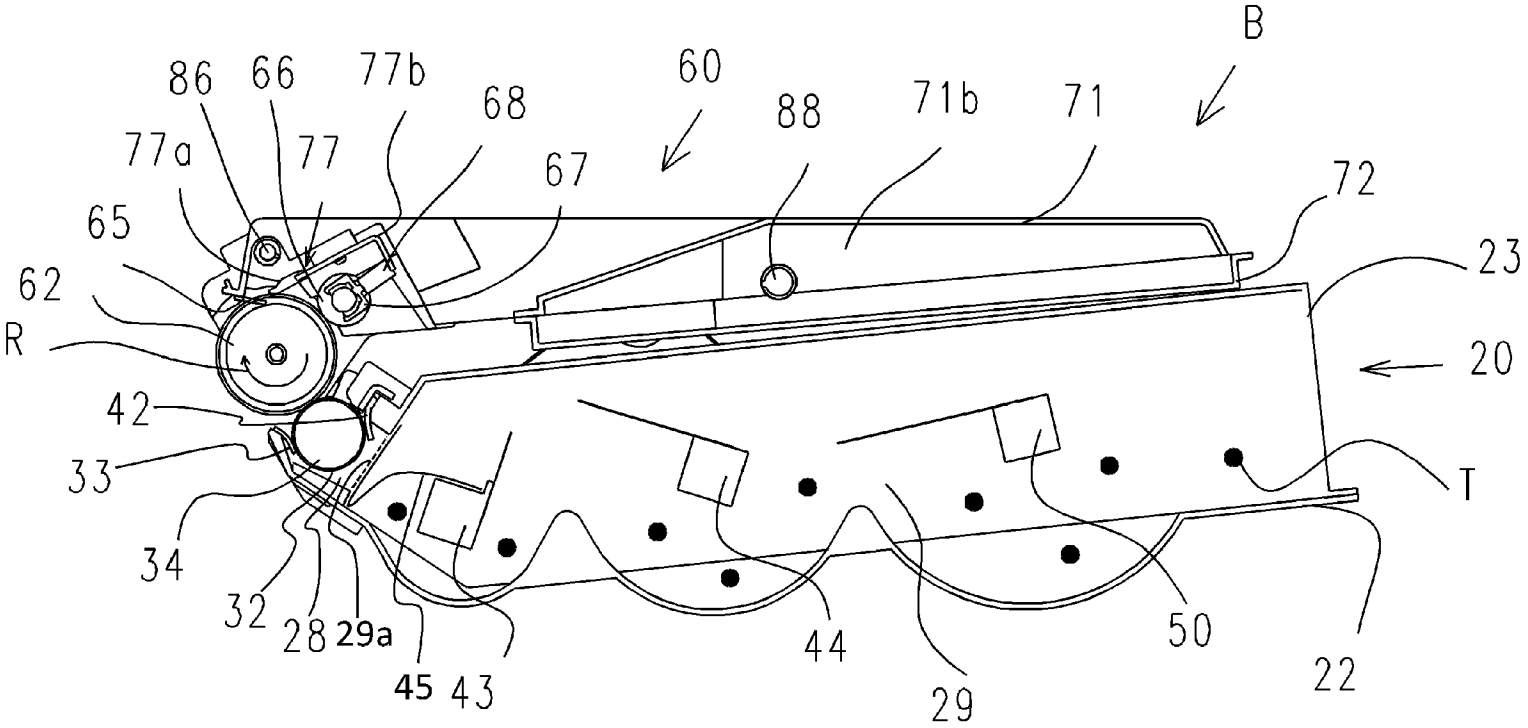
FIG. 3 is a cross-sectional view of the process cartridge according to the first embodiment.

A description will be given, with reference to FIGS. 2 and 3, of the entire configuration and the image forming process of the image forming apparatus. FIG. 2 is a schematic cross-sectional view of the image forming apparatus body (hereinafter called the apparatus body A) and the process cartridge (hereinafter called the cartridge B) of the image forming apparatus according to the embodiment of the present invention. FIG. 3 is a schematic cross-sectional view of the cartridge B. Here, the apparatus body A is a part that does not include the cartridge B among the constituents of the image forming apparatus.

(Entire Configuration of Image Forming Apparatus)

The image forming apparatus according to the embodiment of the present invention shown in FIG. 2 is a laser beam printer using an electrophotographic technology in which the cartridge B is freely attachable/detachable to/from the apparatus body A. In the apparatus body A, an exposure device 3 (laser scanner unit) that forms a latent image on a photosensitive drum 62 of the cartridge B attached to the apparatus body A is arranged. In addition, in the apparatus body A, a sheet tray 4 in which recording media P (hereinafter called sheet materials P) serving as image forming targets are accommodated is arranged under the cartridge B attached to the apparatus body A. Moreover, in the apparatus body A, a pickup roller 5*a*, a pair of feeding rollers 5*b*, a pair of conveyance rollers 5*c*, a transfer guide 6, a transfer roller 7, a conveyance guide 8, a fixation device 9, a pair of ejection rollers 10, an ejection tray 11, and the like are successively arranged along a conveyance direction D of the sheet materials P. Note that the fixation device 9 is constituted by a heating roller 9*a* and a pressure roller 9*b*.

(Image Forming Process)

Next, a description will be given of the outline of the image forming process. Based on a print start signal, the photosensitive drum 62 (hereinafter called the drum 62) is rotationally driven at a prescribed peripheral speed (process speed) in a direction indicated by an arrow R. A charging roller 66 to which a bias voltage has been applied contacts the outer peripheral surface of the drum 62 and uniformly charges the outer peripheral surface of the drum 62. The exposure device 3 outputs laser light L corresponding to image information. The laser light L passes through a laser opening 71*h* provided in a cleaning frame body 71 of the cartridge B and scans and exposes the outer peripheral surface of the drum 62. Thus, an electrostatic latent image corresponding to image information is formed on the outer peripheral surface of the drum 62.

On the other hand, as shown in FIG. 3, in a development unit 20 serving as a development device, toner T inside a toner chamber 29 serving as a developer accommodation portion is stirred and conveyed by the rotation of a first conveyance member 43, a second conveyance member 44, and a third conveyance member 50, and fed to a toner supply chamber 28. The toner T is supported on the front surface of a development roller 32 by the magnetic force of a magnet roller 34 (stationary magnet). The layer thickness of the toner T is restricted on the peripheral surface of the development roller 32, while the toner T is friction-charged by a development blade 42. The toner T is transferred onto a drum 62 according to an electrostatic latent image and visualized as a toner image.

Further, as shown in FIG. 2, in synchronization with the output timing of the laser light L, one of the sheet materials P accommodated at the lower part of the apparatus body A is fed out from the sheet tray 4 by the pickup roller 5*a*, the pair of feeding rollers 5*b*, and the pair of conveyance rollers 5*c*. Then, the sheet material P is conveyed to the transfer position between the drum 62 and the transfer roller 7 via the transfer guide 6. At the transfer position, a toner image is successively transferred from the drum 62 onto the sheet material P. The sheet material P onto which the toner image has been transferred is separated from the drum 62 and conveyed to the fixation device 9 along the conveyance guide 8. Subsequently, the sheet material P passes through the nip portion between the heating roller 9*a* and the pressure roller 9*b* constituting the fixation device 9. After being subjected to pressing/heating fixation process at the nip portion, the toner image is fixed onto the sheet material P. The sheet material P that has been subjected to the fixation process of the toner image is conveyed to the pair of ejection rollers 10 and ejected onto the ejection tray 11.

On the other hand, as shown in FIG. 3, after the transfer, toner remaining on the peripheral surface of the drum 62 is removed by a cleaning blade 77, and the drum 62 will be used in an image forming process again. The toner that has been removed from the drum 62 is stored in a waste toner chamber 71*b* of a cleaning unit 60.

In the above description, the charging roller 66, the development roller 32, the transfer roller 7, and the cleaning blade 77 constitute the process unit acting on the drum 62.

(Attachment/Detachment of Cartridge)

Figure 4:
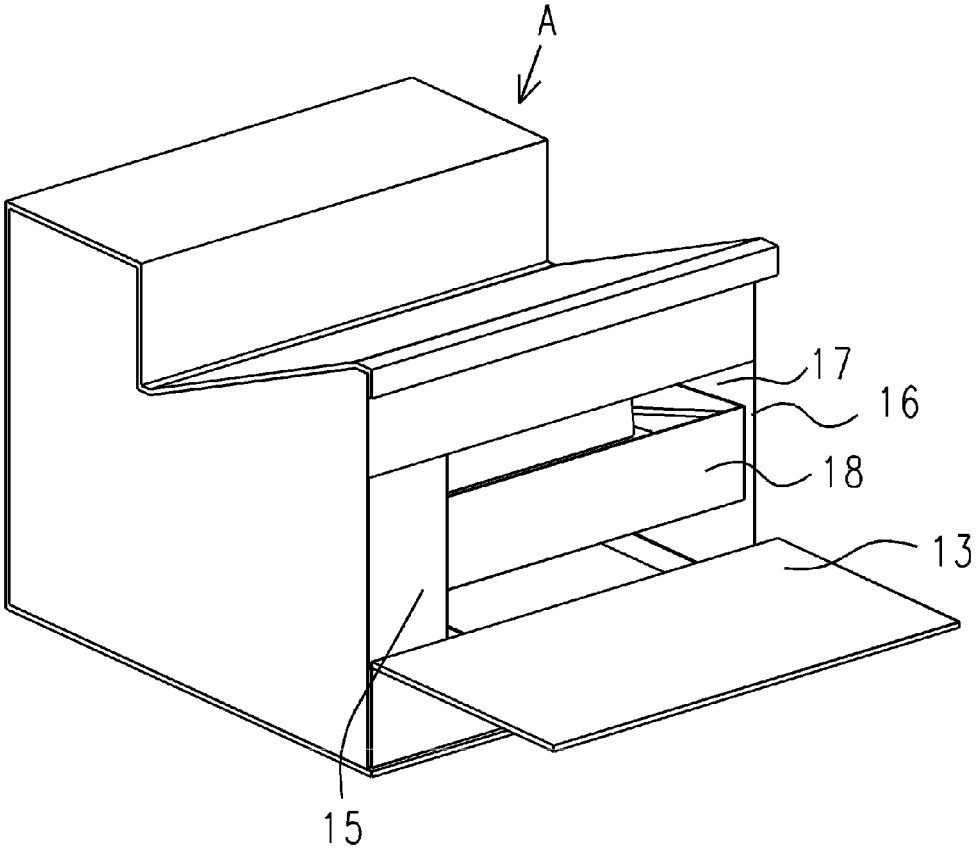
FIG. 4 is a perspective view in a state in which the opening/closing door of the image forming apparatus body is opened.
Figure 5:
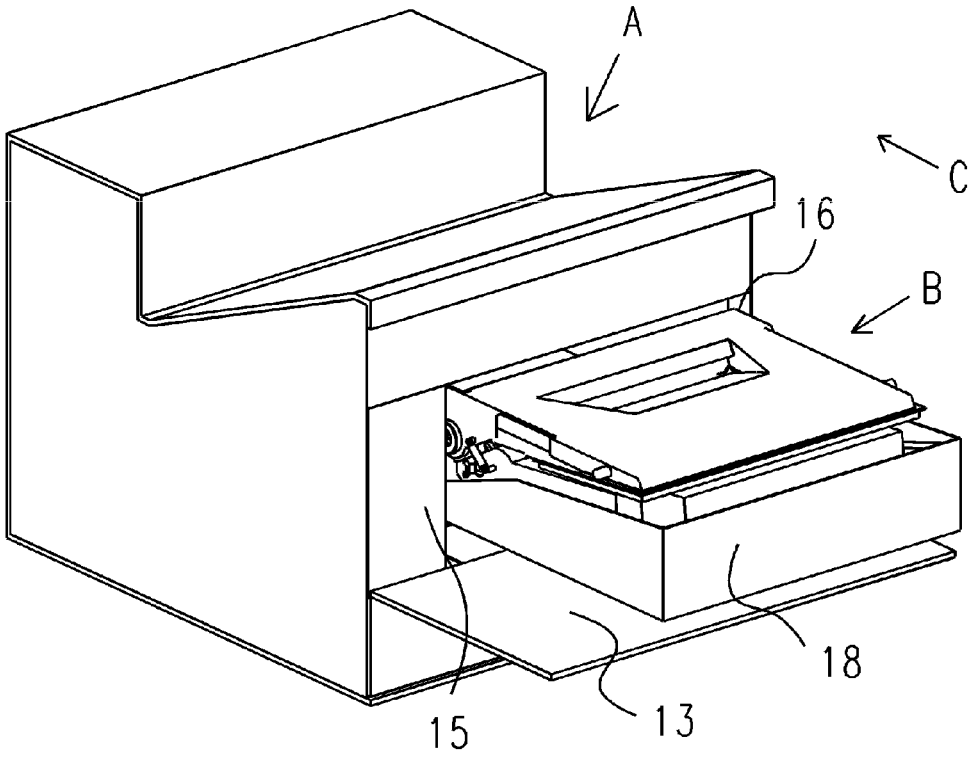
FIG. 5 is a perspective view in a state in which the opening/closing door of the image forming apparatus body is opened and a tray is drawn.
Figure 6:
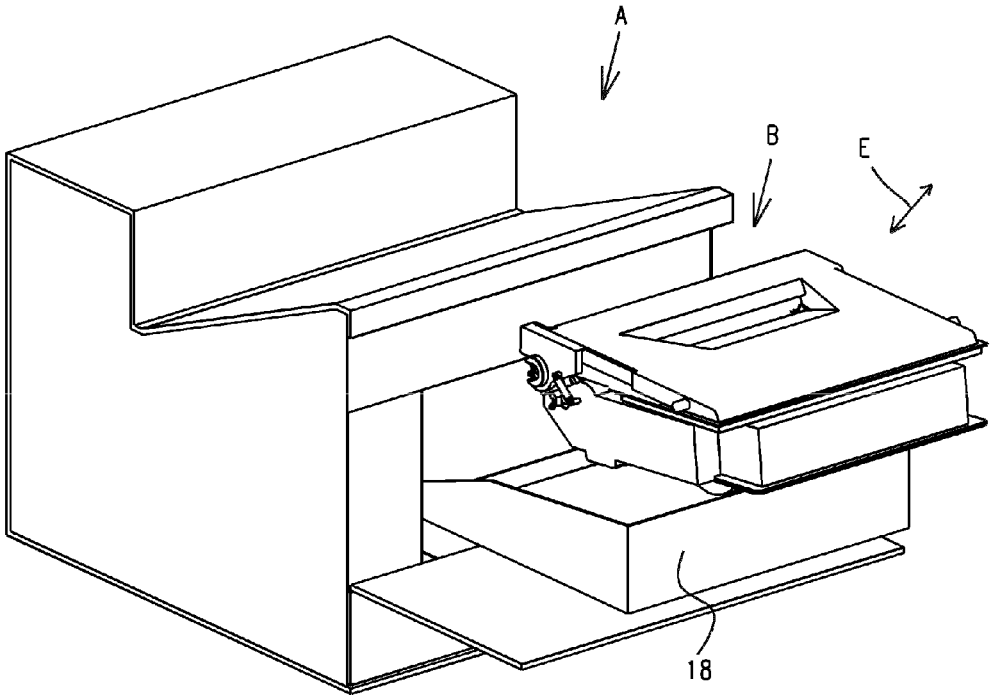
FIG. 6 is a perspective view in a state in which the process cartridge is removed from the image forming apparatus body.

A description will be given, with reference to FIGS. 4, 5, and 6, of the attachment/detachment of the cartridge B to/from the apparatus body A. FIG. 4 is a schematic perspective view of the apparatus body A in which an opening/closing door 13 is opened to attach/detach the cartridge B. FIG. 5 is a schematic perspective view of the apparatus body A and the cartridge B in a state in which the opening/closing door 13 is opened and a cartridge tray 18 is drawn to attach/detach the cartridge B. FIG. 6 is a schematic perspective view where the cartridge B is removed in a state in which the opening/closing door 13 is opened and the tray 18 is drawn.

The opening/closing door 13 is rotatably attached to the apparatus body A, and a cartridge insertion port 17 is configured to appear when the opening/closing door 13 is opened. Inside the cartridge insertion port 17, a tray 18 used to attach the cartridge B to the apparatus body A is provided. When the tray 18 is drawn up to a prescribed position, the cartridge B is made attachable/detachable to/from the tray 18 along an attachment/detachment direction E. Then, in a state of being placed on the tray 18, the cartridge B is attached inside the apparatus body A along a guide rail (not shown) in a direction indicated by an arrow C in FIG. 5.

(Supporting Cartridge)

Figure 1A:
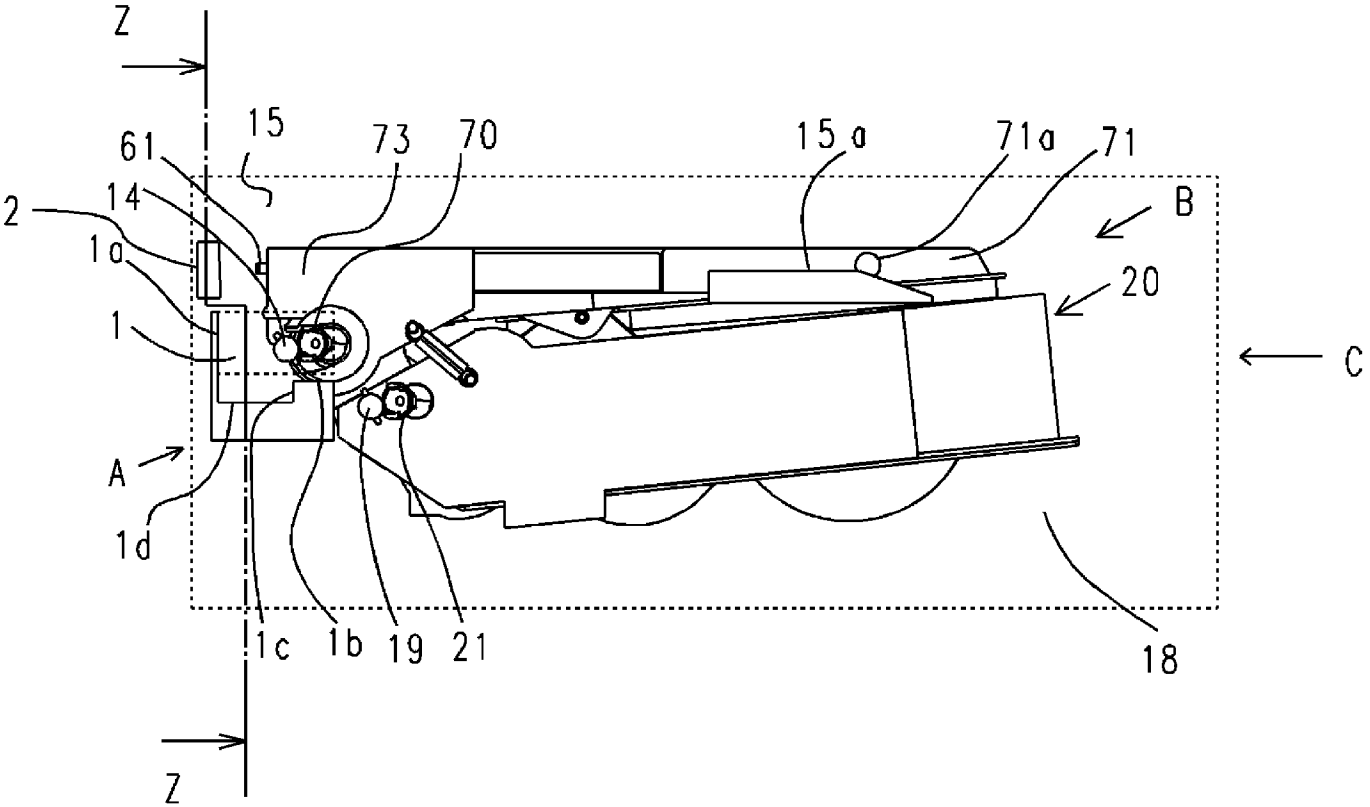
FIGS. 1A and 1B are views each describing the configuration of a process cartridge according to a first embodiment.
Figure 1B:
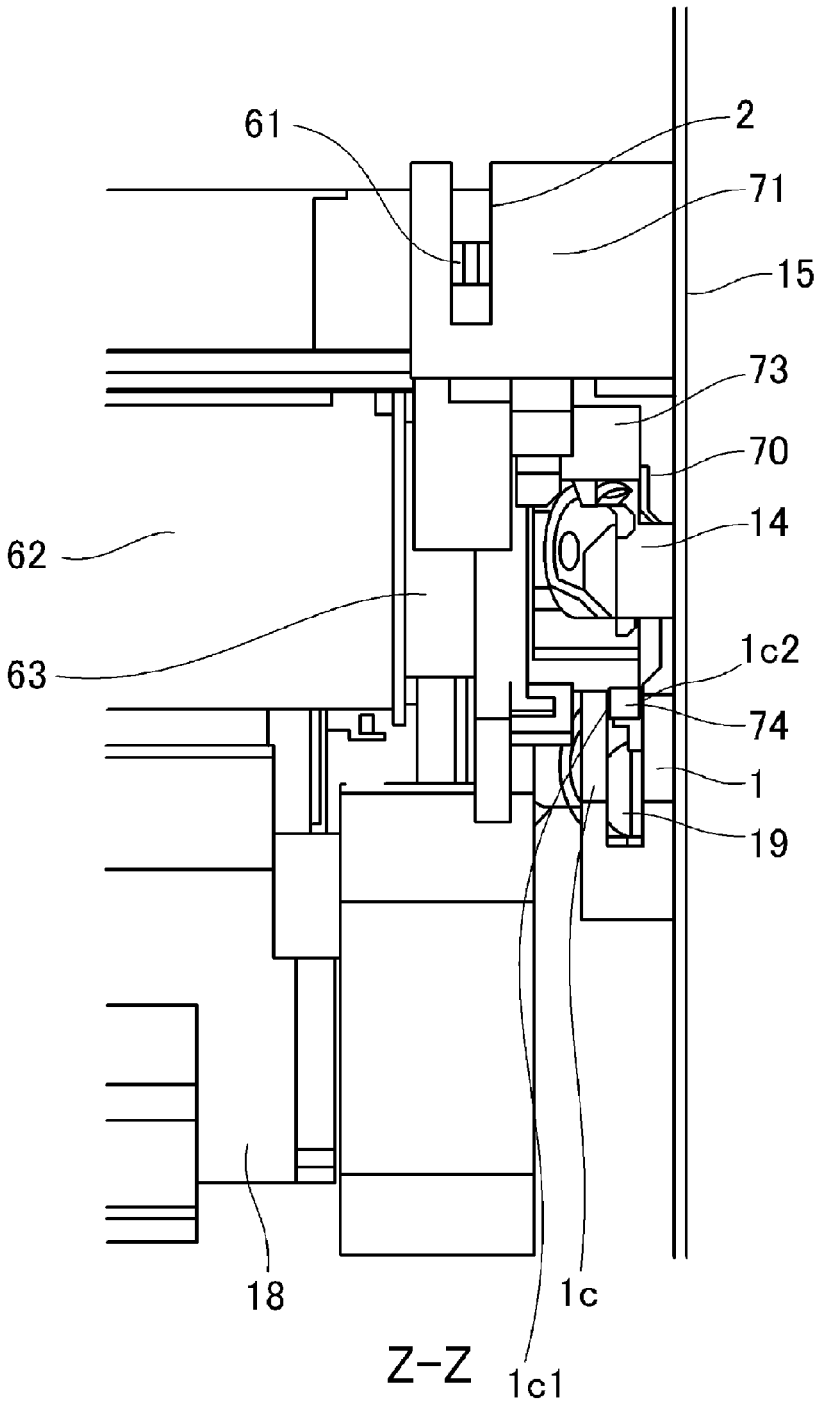
Figure 7:
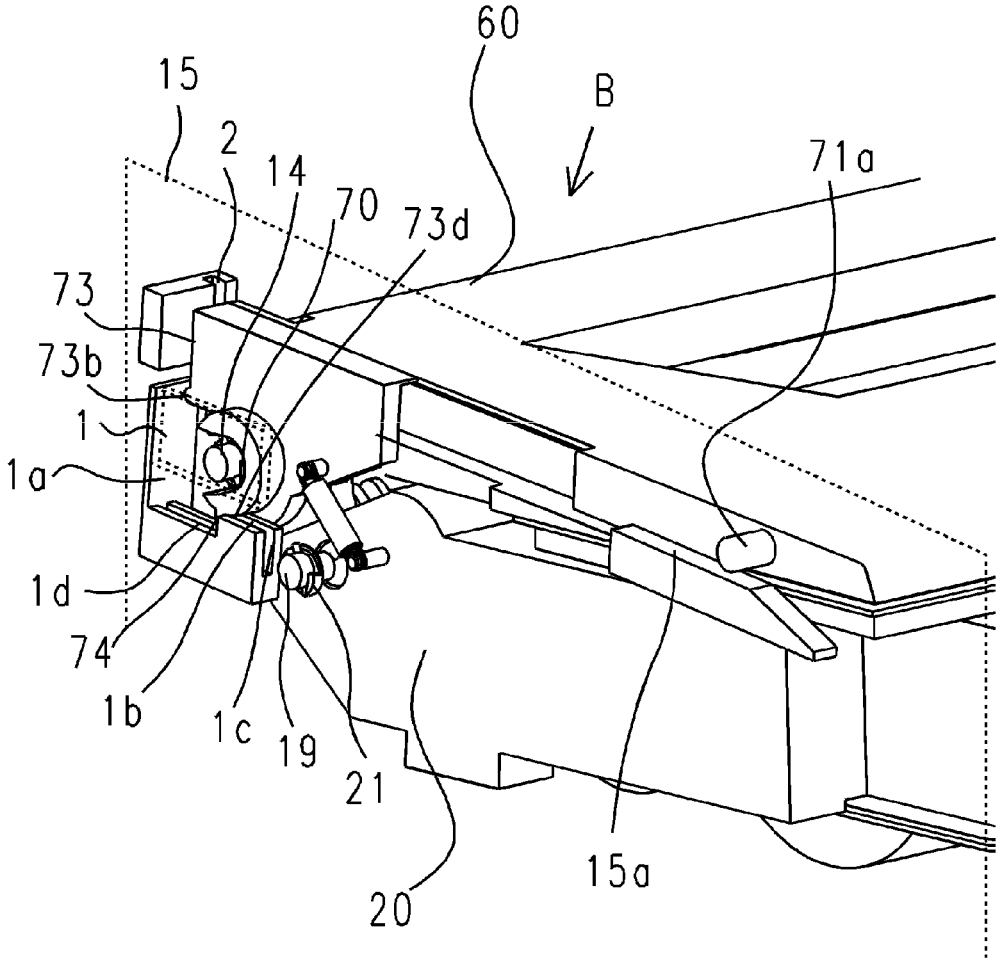
FIG. 7 is a perspective view of a positioning portion on the driving side of the process cartridge according to the first embodiment.
Figure 8:
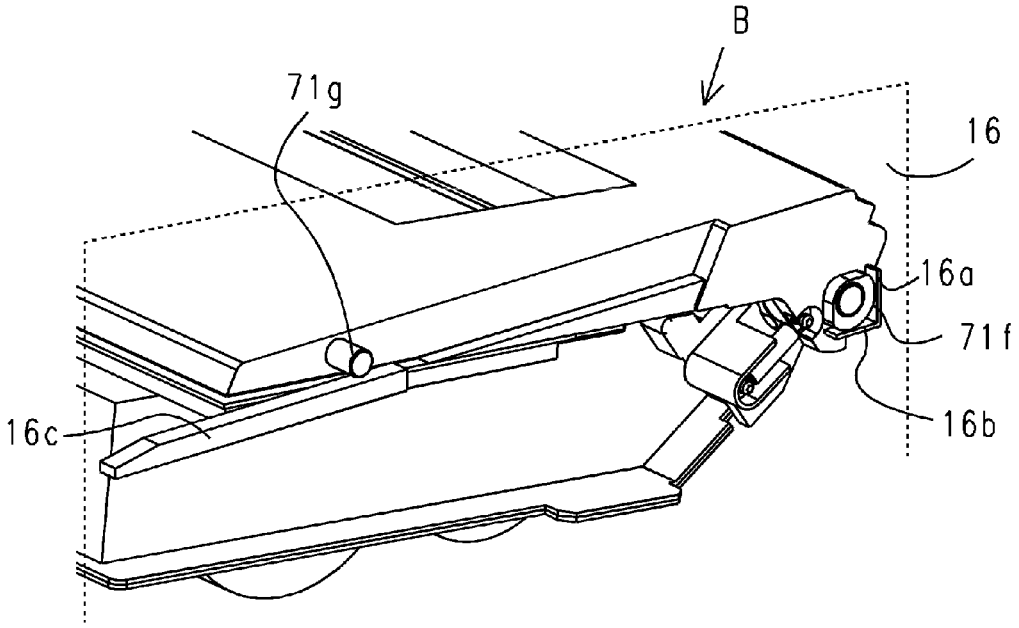
FIG. 8 is a perspective view of a positioning portion on the non-driving side of the process cartridge according to the first embodiment.

A description will be given, with reference to FIGS. 1A, 1B, 4, 7, and 8, of the configuration of supporting the cartridge B in the apparatus body A. FIGS. 1A and 1B are schematic views each describing the configuration of the cartridge B according to a first embodiment. FIG. 1A is a view where the cartridge B and the configuration (i.e., the positioning portion on the driving side) of the cartridge B relating to positioning in the apparatus body A are seen from their lateral sides in the process of attaching the cartridge B to the apparatus body A. FIG. 1B is a view seen from the arrow direction of the Z-Z line of FIG. 1A, i.e., a view where the configuration (i.e., only the periphery of the positioning portion on the driving side) of the cartridge B relating to the positioning with respect to the apparatus body A is seen from the direction opposite to the attachment direction C of the cartridge B. FIG. 7 is a schematic perspective view showing the configuration of the positioning portion on the driving side of the cartridge B according to the first embodiment. FIG. 8 is a schematic perspective view showing the configuration of the positioning portion of the cartridge B on the non-driving side according to the first embodiment.

As shown in FIG. 4, the apparatus body A is provided with a driving-side plate 15 and a non-driving-side plate 16 used to support the cartridge B. In addition, as shown in FIG. 7, a driving shaft support member 1 of the driving-side plate 15, which serves as a part to support the cartridge B, is provided with a driving-side first support portion 1*a*, a driving-side second support portion 1*b*, and a rotation support portion 15*a*. In the driving shaft support member 1, the driving-side first support portion 1*a*, the driving-side second support portion 1*b*, an engaging portion 1*c*, and a notch portion 1*d* are each integrally formed. Moreover, as shown in FIG. 8, the non-driving-side plate 16 is provided with a non-driving-side first support portion 16*a*, a non-driving-side second support portion 16*b*, and a rotation support portion 16*c*.

On the other hand, a first supported portion 73*b* and a second supported portion 73*d* of a drum bearing 73, and a driving-side boss 71*a*, a non-driving-side protrusion portion 71*f*, and a non-driving-side boss 71*g* of the cleaning frame body 71 are provided as the supported portions of the cartridge B. Further, the first supported portion 73*b* is supported by the driving-side first support portion 1*a*, the second supported portion 73*d* is supported by the driving-side second support portion 1*b*, and the driving-side boss 71*a* is supported by a rotation support portion 15*c*. Furthermore, the non-driving-side protrusion portion 71*f* is supported by the non-driving-side first support portion 16*a* and the non-driving-side second support portion 16*b*, and the non-driving-side boss 71*g* is supported by a rotation support portion 16*c*.

Furthermore, as shown in FIGS. 1A, 1B, and 7, when a restricted portion 61 provided on the drum bearing 73 is fitted into a restriction portion 2 provided in the apparatus body A, the position of the cartridge B in a drum axis direction is determined, whereby the cartridge B is positioned inside the apparatus body A.

(Entire Configuration of Cartridge)

Figure 9A:
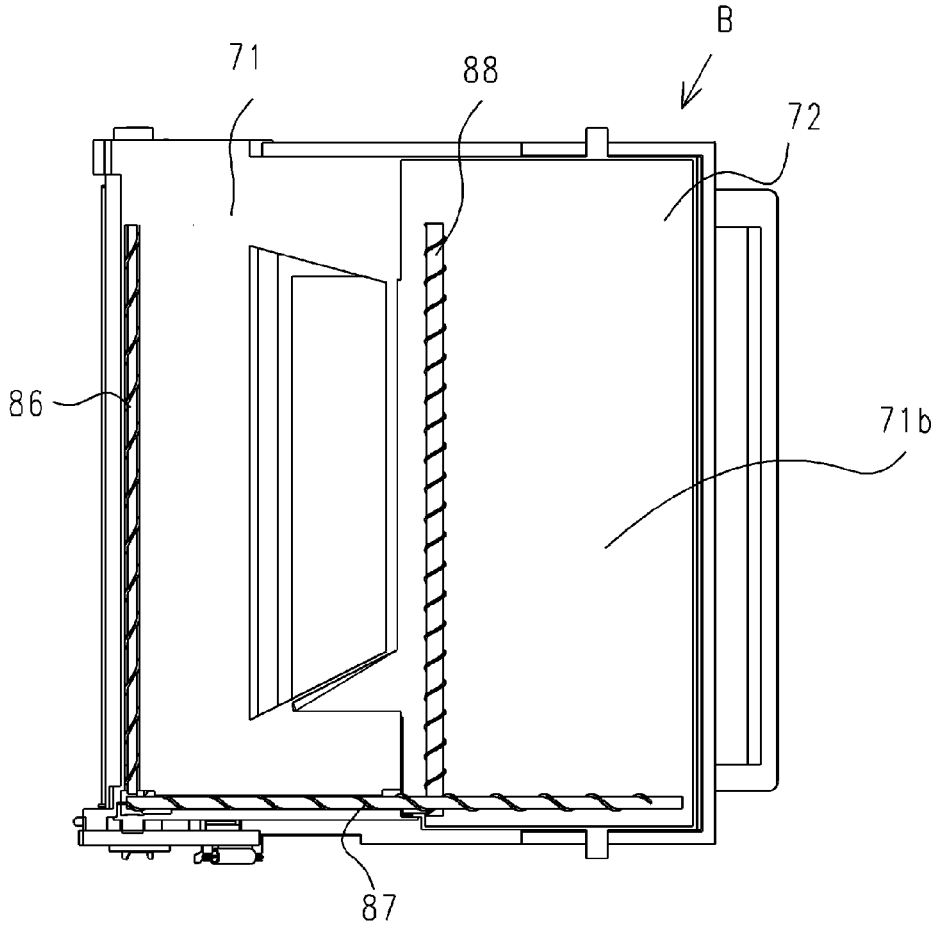
FIGS. 9A and 9B are views each describing the configuration of the process cartridge according to the first embodiment.
Figure 9B:
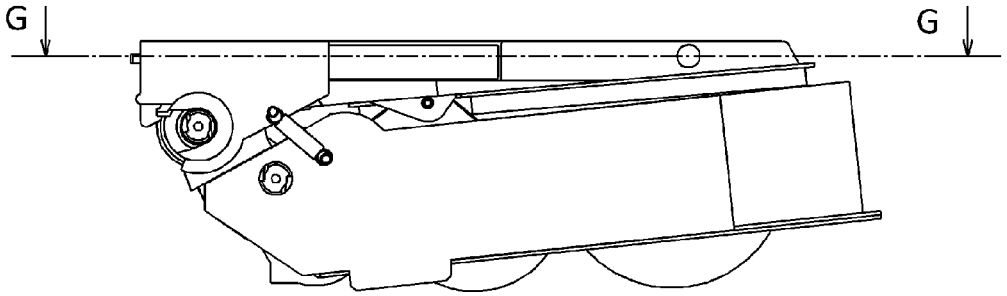
Figure 10:
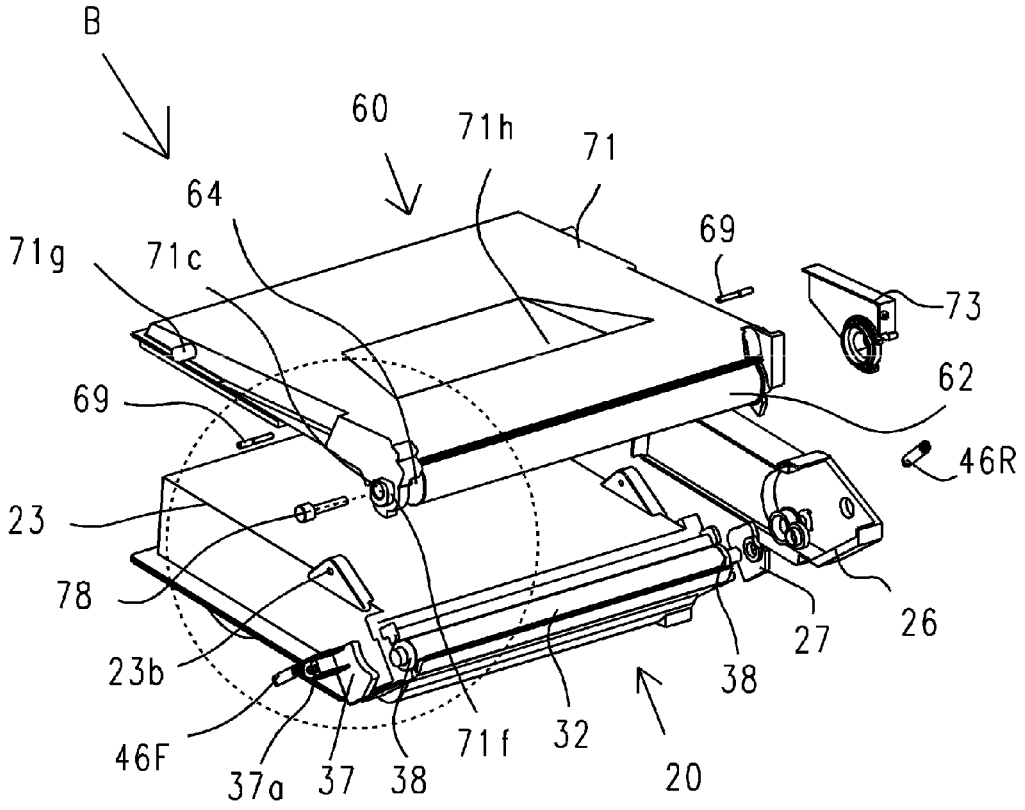
FIG. 10 is an exploded perspective view of the process cartridge according to the first embodiment (non-driving side)
Figure 11:
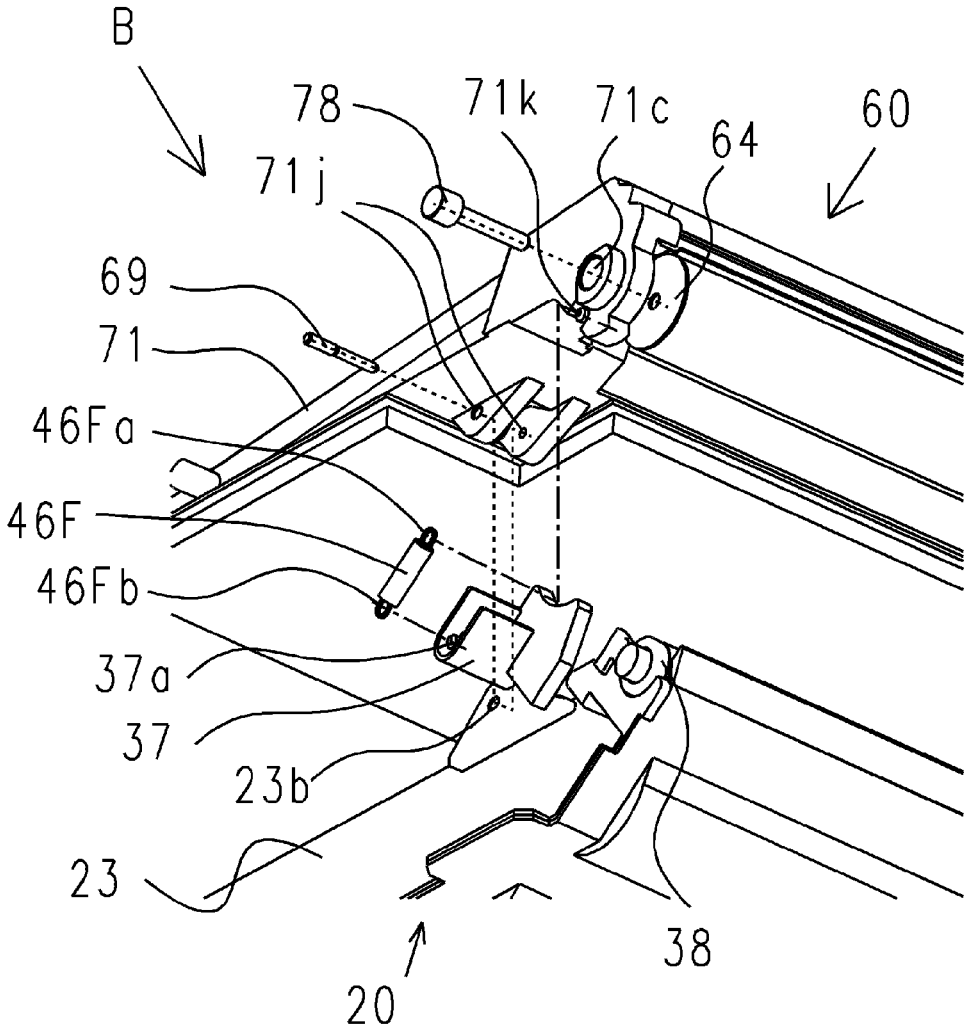
FIG. 11 is an exploded perspective view showing a part of the process cartridge according to the first embodiment (non-driving side)
Figure 12:
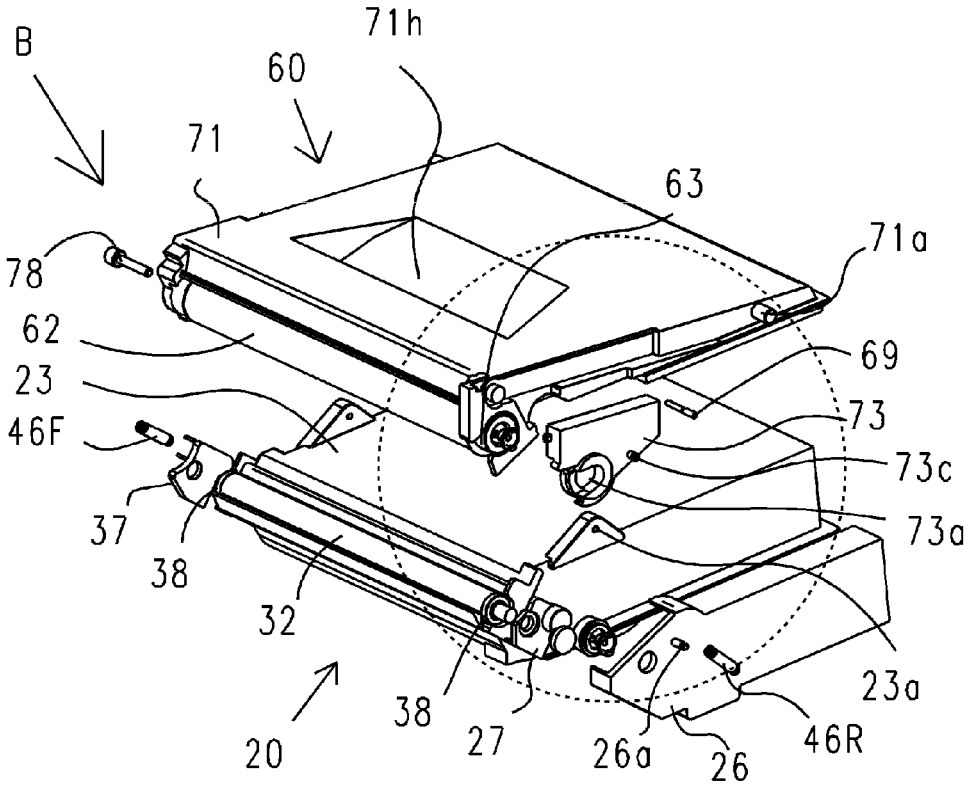
FIG. 12 is an exploded perspective view of the process cartridge according to the first embodiment (driving side)
Figure 13:
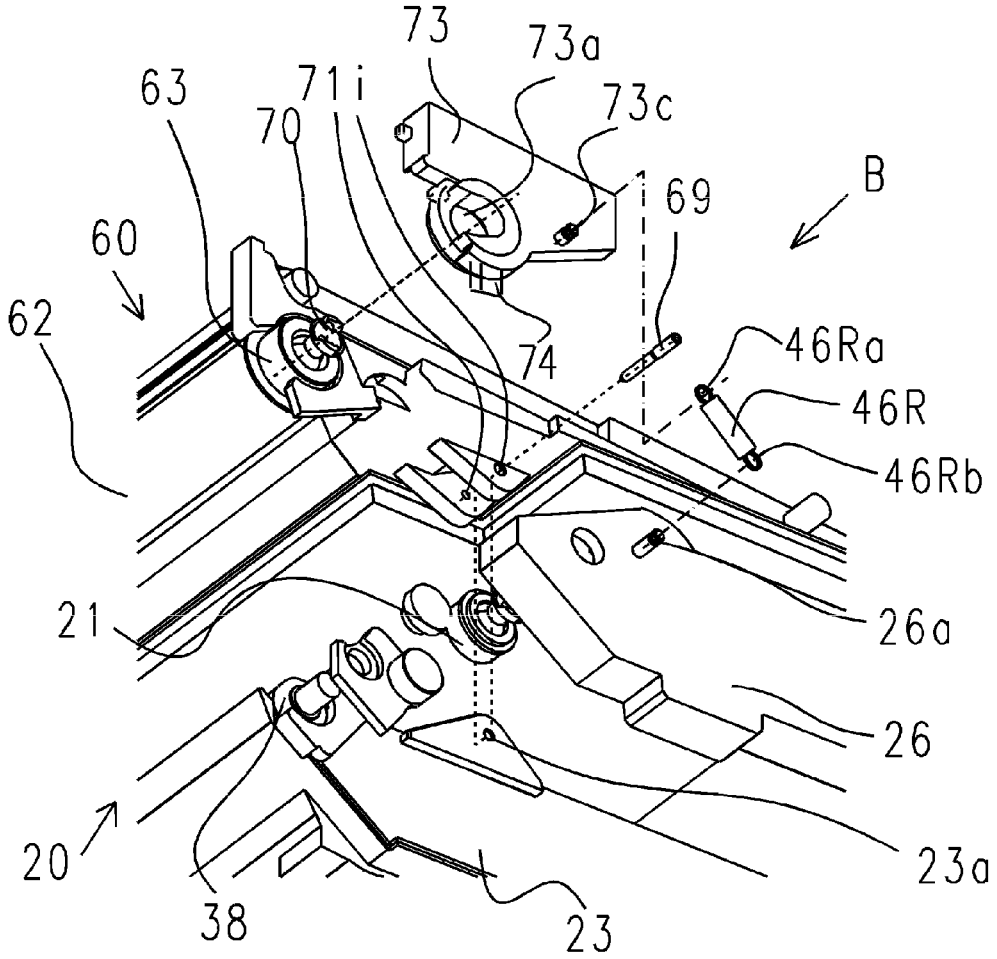
FIG. 13 is an exploded perspective view showing a part of the process cartridge according to the first embodiment (driving side)

A description will be given, with reference to FIGS. 3, 9A, 9B, 10, 11, 12, and 13, of the entire configuration of the cartridge B. FIGS. 9A and 9B are schematic views each describing the configuration of the cartridge B, FIG. 9A being a cross-sectional view seen from the arrow direction of the G-G line of FIG. 9B, FIG. 9B being a side view where the cartridge B is seen from the driving side. FIGS. 10, 11, 12, and 13 are schematic perspective views each describing the configuration of the cartridge B. FIGS. 11 and 13 are views where parts surrounded by dashed lines in FIGS. 10 and 12 are seen from below, respectively. Note that each component is configured to be coupled by a screw in the embodiment, but such a coupling configuration is a conventionally known technique. The coupling configuration is not limited to such a feature and any coupling configuration other than this configuration may be used, and its detailed description will be omitted.

The cartridge B has the cleaning unit 60 and the development unit 20. As shown in FIG. 3, the cleaning unit 60 has the drum 62, the charging roller 66, the cleaning member 77, the cleaning frame body 71 supporting the drum 62, the charging roller 66, and the cleaning member 77, and a cover member 72 fixed to the cleaning frame body 71 by welding or the like. In the cleaning unit 60, each of the charging roller 66 and the cleaning member 77 is arranged in contact with the outer peripheral surface of the drum 62. The cleaning member 77 has a rubber blade 77*a* that is a blade-shaped elastic member made of rubber as an elastic material, and has a support member 77*b* that supports the rubber blade. The rubber blade 77*a* comes in contact with the drum 62 in a direction countering the rotation direction of the drum 62.

That is, the rubber blade 77*a* comes in contact with the drum 62 such that its tip end faces an upstream side in the rotation direction of the drum 62.

FIG. 9A is a cross-sectional view obtained where the cleaning unit 60 is cut off along the line G-G of FIG. 9B. As shown in FIGS. 3, 9A, and 9B, the waste toner chamber 71*b* of the cleaning unit 60 is formed by the cleaning frame body 71 and the cover member 72. Waste toner removed from the front surface of the drum 62 by the cleaning member 77 is conveyed by a first screw 86, a second screw 87, and a third screw 88 that serve as a waste toner conveyance member, and stored in the waste toner chamber 71*b*. In addition, the first screw 86 rotates when a driving force is transmitted from a coupling 21 shown in FIG. 13 by a gear (not shown). Then, the second screw 87 rotates by receiving a driving force from the first screw 86, and the third screw 88 rotates by receiving a driving force from the second screw 87. The first screw 86 is arranged near the drum 62, the second screw 87 is arranged at the end in the longitudinal direction of the cleaning frame body 71, and the third screw 88 is arranged in the waste toner chamber 71*b*. Here, the rotational axes of the first screw 86 and the third screw 88 are parallel to the rotational axis of the drum 62, and the rotational axis of the second screw 87 is orthogonal to the rotational axis of the drum 62. In addition, a drum contact sheet 65 that prevents the waste toner from leaking from the cleaning frame body 71 is provided at the marginal portion of the cleaning frame body 71 so as to come in contact with the drum 62.

The drum 62 is rotationally driven in a direction indicated by an arrow R in the figures according to an image forming operation when receiving a driving force from a body driving motor (not shown) serving as a driving source. The charging roller 66 is rotatably attached to the cleaning unit 60 via charging roller bearings 67 at both ends in the longitudinal direction of the cleaning frame body 71 (substantially parallel to the direction of the rotational axis of the drum 62). The charging roller 66 is brought into press-contact with the drum 62 since the charging roller bearings 67 are pressed toward the drum 62 by an urging member 68. The charging roller 66 rotates following the rotation of the drum 62.

As shown in FIG. 3, the development unit 20 has the development roller 32, a development container 23 that supports the development roller 32, the development blade 42, and the like. In the development roller 32, the magnet roller 34 is provided. In addition, the development blade 42 that restricts a toner layer on the development roller 32 is arranged in the development unit 20. As shown in FIGS. 10 and 12, the development roller 32 is provided with interval retention members 38 at its both ends. When the interval retention members 38 and the drum 62 come in contact with each other, the development roller 32 is retained with a slight gap provided between the development roller 32 and the drum 62.

In addition, as shown in FIG. 3, a development roller contact sheet 33 that prevents the toner from leaking from the development unit 20 is provided at the marginal portion of a bottom member 22 so as to come in contact with the development roller 32. Moreover, in the toner chamber 29 formed by the development container 23 and the bottom member 22, the first conveyance member 43, the second conveyance member 44, and the third conveyance member 50 are provided. The first conveyance member 43, the second conveyance member 44, and the third conveyance member 50 supply the toner to the toner supply chamber 28 while stirring the toner accommodated in the toner chamber 29.

Between the toner chamber 29 and the toner supply chamber 28, an opening portion 29*a* (portion indicated by dashed lines) is provided. The opening portion 29*a* is sealed by a sealing member 45 until the cartridge B is used. The sealing member 45 is a sheet-shaped member made of a material such as polyethylene. The sealing member 45 is welded to the development container 23 on the periphery of the opening portion 29*a* on its one end side and fixed to the first conveyance member 43 on the other end side. Then, when the first conveyance member 43 rotates at the first use of the cartridge B, the sealing member 45 is wound by the first conveyance member 43 while its part welded to the development container 23 is peeled off, whereby the opening portion 29*a* is opened.

As shown in FIGS. 10 and 12, the cartridge B is constituted by the combination of the cleaning unit 60 and the development unit 20. The cleaning unit 60 is provided with the cleaning frame body 71, the cover member 72, the drum 62, and the drum bearing (bearing member) 73 and a drum shaft 78 that rotate and support the drum 62. As shown in FIG. 13, on the driving side, a driving-side drum flange 63 of the drum 62 provided on the driving side is rotatably supported by a hole portion 73*a* of the drum bearing 73. On the other hand, as shown in FIG. 11, on the non-driving side, the drum shaft 78 press-fitted into a hole portion 71*c* provided in the cleaning frame body 71 is configured to rotatably support the hole portion (not shown) of a non-driving-side drum flange 64.

On the other hand, as shown in FIGS. 3, 10, and 12, the development unit 20 is constituted by the bottom member 22, the development container 23, a driving-side development side member 26, the development blade 42, the development roller 32, and the like. In addition, the development roller 32 is rotatably attached to the development container 23 by bearing members 27 and 37 provided at its both ends.

As shown in FIGS. 11 and 13, the cleaning unit 60 and the development unit 20 are rotatably coupled to each other by coupling pins 69 to constitute the cartridge B. Specifically, at both ends of the development unit 20 in the longitudinal direction, the development container 23 is provided with a first development support hole 23*a* and a second development support hole 23*b*. In addition, at both ends of the cleaning unit 60 in the longitudinal direction, the cleaning frame body 71 is provided with first hanging holes 71*i* and second hanging holes 71*j*. When the coupling pins 69 press-fitted into the first hanging holes 71*i* and the second hanging holes 71*j* are fitted into the first development support hole 23*a* and the second development support hole 23*b*, the cleaning unit 60 and the development unit 20 are rotatably coupled to each other.

In addition, a first hole portion 46Ra of the driving-side urging member 46R is hooked on a boss 73*c* of the drum bearing 73, and a second hole portion 46Rb is hooked on a boss 26*a* of the driving-side development side member 26. Moreover, a first hole portion 46Fa of a non-driving-side urging member 46F is hooked on a boss 71*k* of the cleaning frame body 71, and a second hole portion 46Fb is hooked on a boss 37*a* of the bearing member 37. In the embodiment, the driving-side urging member 46R and the non-driving-side urging member 46F are formed by tension springs. When the development unit 20 is urged to the cleaning unit 60 by the urging forces of the springs, the development roller 32 is configured to be reliably pressed in the direction of the drum 62. Further, by the interval retention members 38 provided at both ends of the development roller 32, the development roller 32 is retained at a prescribed interval from the drum 62.

(Configuration of Transmitting Driving Force from Apparatus Body to Cartridge)

Figure 14A:
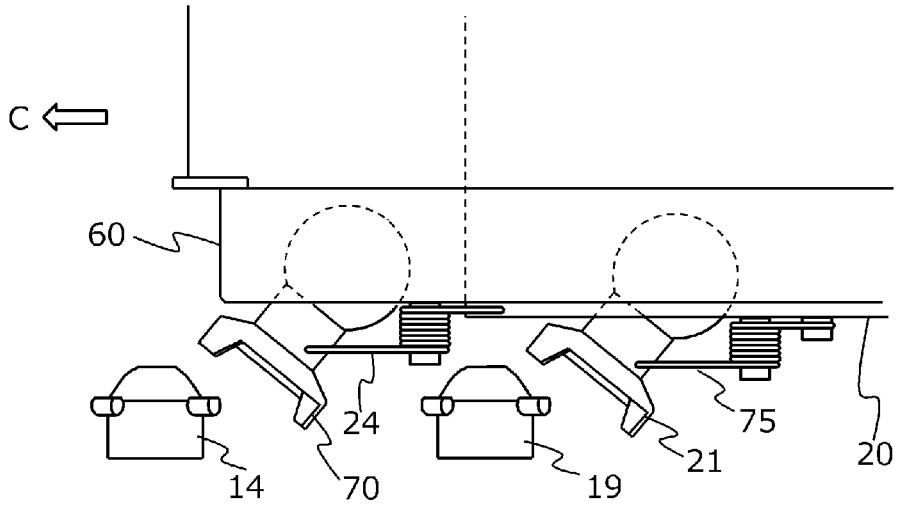
FIGS. 14A and 14B are top views of the coupled parts between the apparatus body and the process cartridge according to the first embodiment.
Figure 14B:
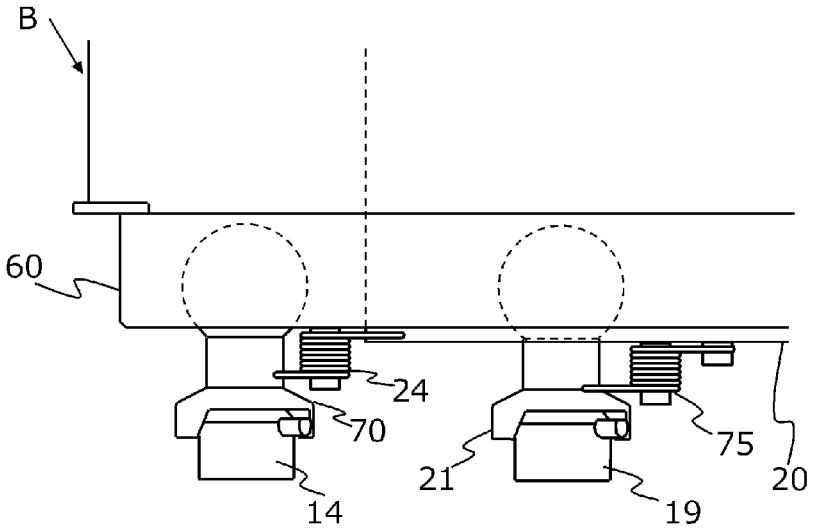

A description will be given, with reference to FIGS. 7, 14A, and 14B, of the configuration of inputting a driving force from the apparatus body A to the cartridge B. FIGS. 14A and 14B are schematic views (top views) each describing the configuration of the coupled parts between the apparatus body A and the cartridge B according to the first embodiment, FIG. 14A showing a state before couplings are coupled, FIG. 14B showing a state after the couplings are coupled.

As shown in FIG. 7, the side surface of the cartridge B is provided with a drum coupling 70 and a development coupling 21 that receive a driving force from the apparatus body A. Here, the drum coupling 70 is provided at the cleaning unit 60, and the development coupling 21 is provided at the development unit 20. Both the drum coupling 70 and the development coupling 21 are configured to be capable of being inclined with respect to the cartridge B (with respect to the rotational axes of the drum 62 and the development roller 32). By the attachment/detachment operation of the cartridge B, the drum coupling 70 and the development coupling 21 are inclined with respect to the rotational axes of the drum 62 and the development roller 32 to be engaged/disengaged with/from the first driving shaft 14 and the second driving shaft 19 of the apparatus body A, respectively.

As shown in FIG. 14A, when the cartridge B is not attached, the drum coupling 70 and the development coupling 21 are urged by torsion coil springs 24 and 75 to be put into an inclined state in which the tip ends face a downstream side in the insertion direction C. As shown in FIG. 14B, when the cartridge B is attached to the apparatus body A, the drum coupling 70 and the development coupling 21 are engaged with the first driving shaft 14 and the second driving shaft 19, respectively. In the process of the engagement, the drum coupling 70 and the development coupling 21 are oriented in a direction along the rotational axes of the drum 62 and the development roller 32 (i.e., the drum coupling 70 and the development coupling 21 are released from the inclined state) to be put into a state in which the drum coupling 70 and the development coupling 21 are allowed to receive a driving force from the apparatus body A. That is, when the protrusion portions of the first driving shaft 14 that protrude in a radial direction are hooked on notch portions formed at the concave-shaped margin of the drum coupling 70, the first driving shaft 14 and the drum coupling 70 are put into a coupled state. The rotation of the first driving shaft 14 is transmitted to the drum coupling 70 to rotate the drum 62. The development coupling 21 and the second driving shaft 19 are also configured in the same way. Note that a coupling configuration by which it is possible to couple the drum 62, the development roller 32, and the driving shafts to each other is not limited to the configuration described herein, but conventionally-known other configurations may be used.

(Configuration of Positioning Drum in Axis Direction with Respect to Driving Shaft of Apparatus Body)

Figure 15A:
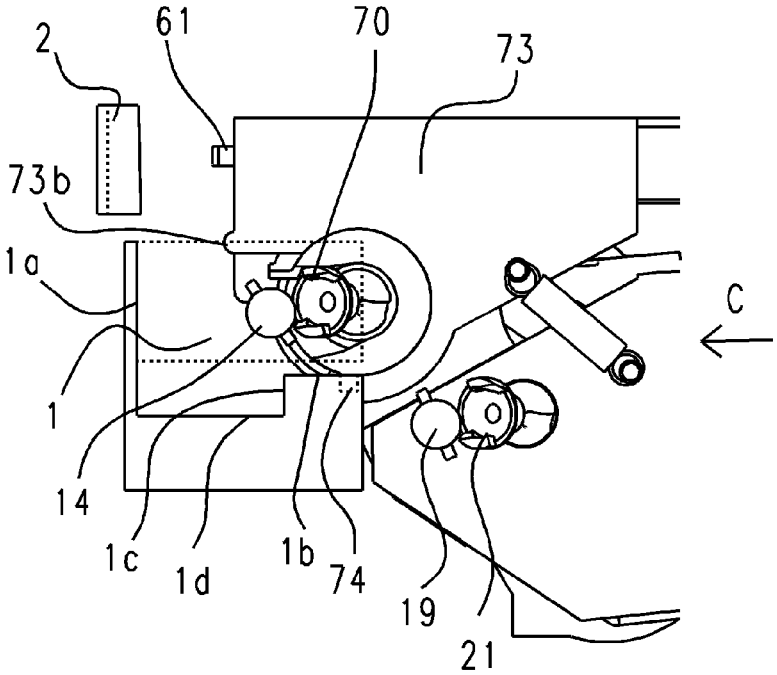
FIGS. 15A and 15B are side views of the coupled parts between the apparatus body and the process cartridge according to the first embodiment.
Figure 15B:
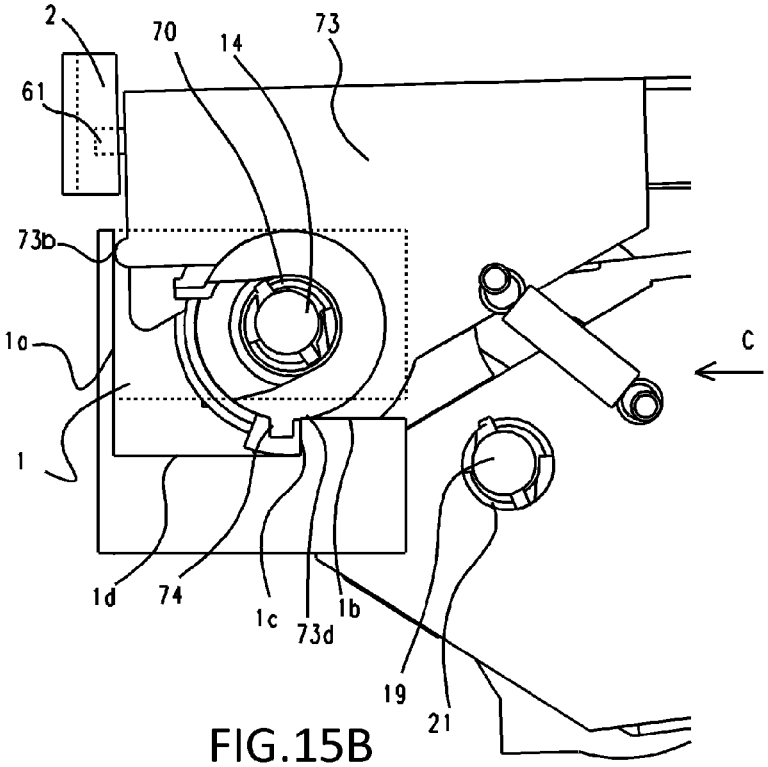
Figure 16A:
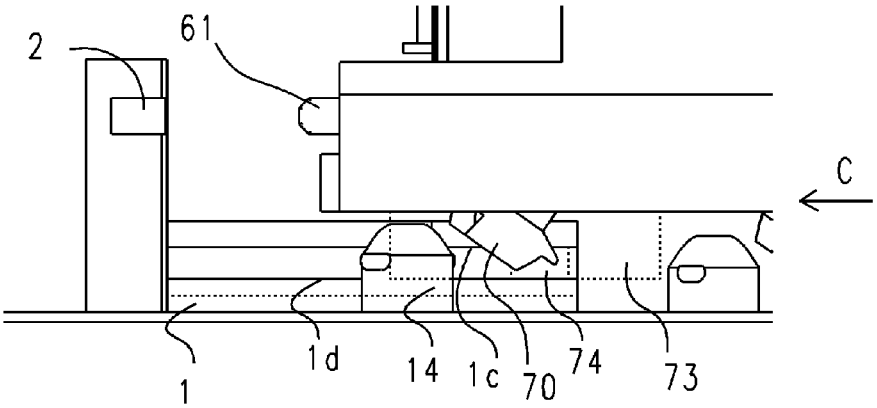
FIGS. 16A and 16B are top views of the coupled parts between the apparatus body and the process cartridge according to the first embodiment.
Figure 16B:
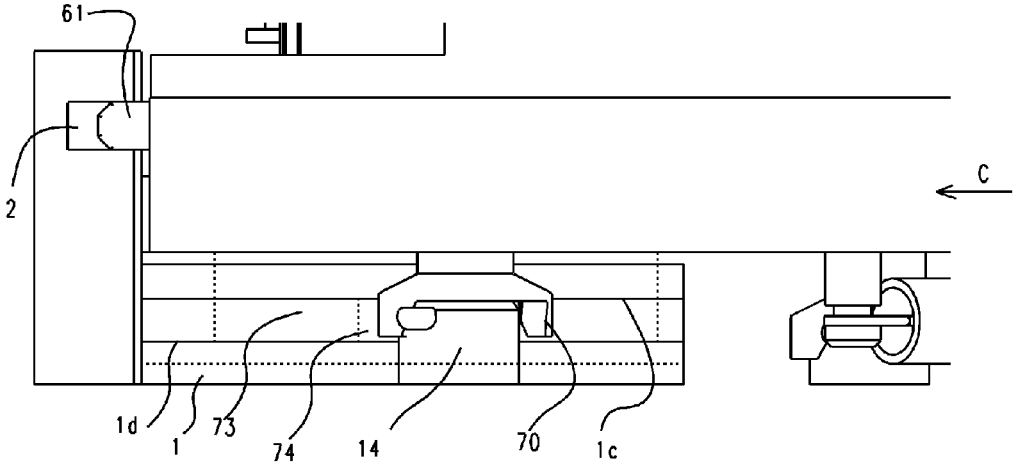

A description will be given, with reference to FIGS. 1A, 1B, 7, 13, 15A, 15B, 16A, and 16B, of the configuration of positioning the drum 62 in the axis direction with respect to the first driving shaft 14 of the apparatus body A. FIGS. 15A and 15B are schematic views (side views) each describing the configuration of the coupled parts between the apparatus body A and the cartridge B according to the first embodiment, FIG. 15A showing the state before the couplings are coupled, FIG. 15B showing the state after the couplings are coupled. FIGS. 16A and 16B are schematic views (top views) each describing the configuration of the coupled parts between the apparatus body A and the cartridge B according to the first embodiment, FIG. 16A showing the state before the couplings are coupled, FIG. 16B showing the state after the couplings are coupled.

As shown in FIGS. 1A, 1B, and 7, the first driving shaft 14 of the apparatus body A is rotatably supported by the driving shaft support member 1 provided at the driving-side plate 15, and the driving shaft support member 1 is provided with the engaging portion 1*c*. That is, the engaging portion 1*c* is arranged at a part on the driving side (one end side) of the apparatus body A in the longitudinal direction. The engaging portion 1*c* is provided with a first contact surface 1*c*1 and a second contact surface 1*c*2 that are surfaces orthogonal to the longitudinal direction. The drum 62 of the cartridge B is rotatably supported by the drum bearing 73 as a drum unit integrated with the drum coupling 70, and the drum bearing 73 is provided with an engaged portion 74. That is, the engaged portion 74 is arranged at a part on the driving side (one end side) of the cartridge B in the longitudinal direction.

As shown in FIG. 15A, when the cartridge B is attached in the direction indicated by the arrow C, the engaged portion 74 of the drum bearing 73 is engaged with the engaging portion 1*c* of the driving shaft support member 1. That is, the engaged portion 74 and the engaging portion 1*c* come in contact with each other in the process of attaching the cartridge B, whereby the position of the cartridge B in the axis direction of the drum 62 is determined. In other words, when the engaged portion 74 is engaged with the engaging portion 1*c* to restrict the movement of the drum bearing 73 in the rotational axis direction with respect to the apparatus body A, the rotational axis of the drum 62 pivotally supported by the drum bearing 73 is positioned with respect to the apparatus body A. Specifically, in the engagement state in which the engaged portion 74 is engaged with the engaging portion 1*c*, the movement of the drum bearing 73 to at least the non-driving side in the longitudinal direction is restricted. In other words, when the engaged portion 74 comes in contact with the first contact surface 1*c*1 (see FIG. 1B) of the engaging portion 1*c*, the movement of the drum bearing 73 to the non-driving side in the longitudinal direction is restricted. According to the embodiment, in the engagement state, the movement of the drum bearing 73 to the driving side in the longitudinal direction is further restricted. In other words, when the engaged portion 74 comes in contact with the second contact surface 1*c*2 (see FIG. 1B) of the engaging portion 1*c*, the movement of the drum bearing 73 to the driving side in the longitudinal direction is restricted. This positioned state (engagement state) is maintained until at least the drum coupling 70 is coupled to the first driving shaft 14 in the process of attaching the cartridge B to the apparatus body A.

As shown in FIGS. 7 and 13, since the drum 62 is provided via the drum coupling 70, the driving-side drum flange 63, and the drum bearing 73 while the driving shaft 14 is provided via only the driving shaft support member 1, the component tolerance between the drum 62 and the driving shaft 14 reduces. As shown in FIG. 15B, the engaging portion 1*c* is provided with the notch portion 1*d* on a downstream side in the attachment direction of the cartridge B. Thus, the engaging portion 1*c* and the engaged portion 74 are not allowed to come in contact with each other in the process of further attaching the cartridge B to the apparatus body A, whereby the positioning of the drum 62 and the cartridge B in the drum axis direction is released. That is, the engagement state between the engaged portion 74 and the engaging portion 1*c* is released before the cartridge B reaches an attachment completing position in the apparatus body A.

In addition, as shown in FIGS. 16A and 16B, after the positioning of the cartridge B in the drum axis direction is released, a restricted portion 61 (second engaging portion) provided on the drum bearing 73 is inserted in a concave portion (second engaged portion) of a restriction portion 2 provided in the apparatus body A in the insertion direction C as described above. Moreover, when the cartridge B reaches the attachment completing position in the apparatus body A, the first supported portion 73*b* (contact portion) of the drum bearing 73 comes in contact with the driving-side first support portion 1*a* of the driving shaft support member 1 in the insertion direction C. Thus, the position of the cartridge B in the drum axis direction and the position of the cartridge B in the direction orthogonal to the axis direction at image formation are determined. At this time, the drum coupling 70 and the development coupling 21 are engaged with the first driving shaft 14 and the second driving shaft 19, respectively, to be put into the state in which the drum coupling 70 and the development coupling 21 are allowed to receive a driving force from the apparatus body A.

As described above, the positioning of the drum 62 in the rotational axis direction is temporarily performed by the engagement between the engaged portion 74 and the engaging portion 1*c* until at least the coupling of the drum coupling 70 and the first driving shaft 14 is completed in the process of attaching the cartridge B. Subsequently, after the coupled state between the drum coupling 70 and the first driving shaft 14 is formed, the restriction in the axis direction is temporarily released and then the final positioning of the cartridge B with respect to the apparatus body A at the attachment completing position is performed. That is, by the release of the restriction, the influence of dimensional variation in the restriction configuration for the temporal positioning on the final positioning may be suppressed. With the above configuration, it becomes possible to absorb variation or the like in the dimensional accuracy or the assembling accuracy between the constituent of the coupling portion and the constituent for the final positioning of the cartridge B to a certain extent.

Note that the embodiment describes the two driving input mechanisms of the drum coupling 70 and the development coupling 21, but the mechanisms are not limited to these and any other driving input mechanisms may be employed. The embodiment describes the case in which the configuration of temporarily positioning the rotation member in the axis direction at the attachment of the cartridge according to the present invention is applied to the configuration of coupling the photosensitive drum 62, but may be applied to the configuration of coupling the development roller 32 or applied to any other similar configurations.

In the way described above, the position of the photosensitive drum 62 in the axis direction in the apparatus body A may be more accurately determined in the process of attaching the cartridge B to the apparatus body A.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-203210, filed Oct. 14, 2015, and Japanese Patent Application No. 2016-163642, filed Aug. 24, 2016, which are hereby incorporated by reference herein in their entirety.

What is claimed is:

1. A cartridge configured to be removably attachable to an apparatus body of an image forming apparatus, the cartridge comprising:

a rotation member including a coupling configured to be coupleable to a driving shaft provided in the apparatus body and to rotate by receiving a driving force from the driving shaft; and a bearing member configured to pivotally support the rotation member, wherein the bearing member includes an engaged portion that is positioned on one end side of the cartridge in a direction of a rotational axis of the rotation member and configured to engage with an engaging portion provided in the apparatus body, such that an engagement state between the engaged portion and the engaging portion is maintained until at least the coupling is coupled to the driving shaft in a process of attaching the cartridge to the apparatus body, and such that a movement of the bearing member towards, at least, the other end side of the cartridge in the direction of the rotational axis is restricted when the engaged portion and the engaging portion are put into the engagement state.

2. The cartridge according to claim 1, wherein the engaged portion and the engaging portion are configured such that, when in use, the engagement state between the engaged portion and the engaging portion is released before the cartridge reaches an attachment completing position in the apparatus body.

3. The cartridge according to claim 1, wherein the bearing member further includes a second engaged portion to be engaged with a second engaging portion provided in the apparatus body such that a movement of the cartridge in the direction of the rotational axis with respect to the apparatus body is restricted at an attachment completing position in the apparatus body.

4. The cartridge according to claim 3, wherein the engaged portion and the engaging portion are configured such that, when in use, the engagement state between the engaged portion and the engaging portion is released before the second engaged portion is engaged with the second engaging portion.

5. The cartridge according to claim 1, wherein the bearing member further includes a contact portion that comes in contact with a member, which is provided with the engaging portion in the apparatus body, at an attachment completing position of attaching the cartridge to the apparatus body in a direction of inserting the cartridge into the apparatus body when attaching.

6. The cartridge according to claim 1, wherein the rotation member is a photosensitive drum.

7. The cartridge according to claim 1, wherein the rotation member is a charging roller.

8. An image forming apparatus in which a cartridge provided with a rotation member is configured to be removably attachable to an apparatus body having a driving shaft that configured to transmit a driving force to the rotation member, wherein the apparatus body includes a support member configured to rotatably and pivotally support the driving shaft and having an engaging portion configured to restrict movement of the rotation member in the direction of a rotational axis of the rotation member, and wherein the cartridge includes a bearing member configured to pivotally support the rotation member and an engaged portion, the engaged portion being positioned at one end side of the cartridge in the direction of the rotational axis of the rotation member and being engageable with the engaging portion, such that an engagement state between the engaging portion and the engaged portion is maintained until the rotation member is coupled to the driving shaft in a process of attaching the cartridge to the apparatus body, and such that a movement of the bearing member towards, at least, the other end side of the cartridge in the direction of the rotational axis of the rotation member is restricted when the engaged portion and the engaging portion are put into the engagement state.

9. The image forming apparatus according to claim 8, wherein the engaged portion and the engaging portion are configured such that, when in use, the engagement state between the engaged portion and the engaging portion is released before the cartridge reaches an attachment completing position in the apparatus body.

10. The image forming apparatus according to claim 8, wherein the bearing member has a second engaged portion to be engaged with a second engaging portion provided in the apparatus body such that a movement of the cartridge in the direction of the rotational axis of the rotation member is restricted at an attachment completing position of attaching the cartridge to the apparatus body.

11. The image forming apparatus according to claim 10, wherein the engaged portion and the engaging portion are configured such that, when in use, the engagement state between the engaged portion and the engaging portion is released before the second engaged portion is engaged with the second engaging portion.

12. The image forming apparatus according to claim 8, wherein the bearing member includes a contact portion that comes in contact with the support member at an attachment completing position of attaching the cartridge to the apparatus body in a direction of inserting the cartridge into the apparatus body when attaching.

13. The image forming apparatus according to claim 8, wherein the rotation member is a photosensitive drum.

14. The image forming apparatus according to claim 8, wherein the rotation member is a charging roller.

* * * * *